US005784900A

United States Patent [19]

Czupryniak

[11] Patent Number: 5,784,900

[45] Date of Patent: Jul. 28, 1998

[54] BODY JEWELRY

[76] Inventor: Patrick Czupryniak, R.R. #5 Dwyer Hill Road Smiths Falls, Ontario, Canada, K7A 4S6

[21] Appl. No.: 865,224

[22] Filed: May 29, 1997

[51] Int. Cl.[6] ..... A44C 1/00

[52] U.S. Cl. ..... 63/3; 63/3.1; 63/20

[58] Field of Search ..... 63/3, 3.1, 3.2, 63/15, 15.5, 33, 1.18, 20

[56] References Cited

U.S. PATENT DOCUMENTS

| | | | |
|---|---|---|---|
| 4,625,526 | 12/1986 | Milawski . | |
| 5,125,244 | 6/1992 | Zwart . | |
| 5,239,841 | 8/1993 | Zwart . | |
| 5,609,042 | 3/1997 | Williams | 63/20 |

*Primary Examiner*—Kien T. Nguyen
*Attorney, Agent, or Firm*—Schmeiser, Olsen & Watts

[57] ABSTRACT

A jewelry device comprises a unitary body having defined therein an aperture, a clamping member disposed within the aperture, and a shaft for displacing the clamping member between an open position and a closed position within the aperture. The aperture is sized to accommodate a part of the body to be decorated, such as the nipple of a breast, when the clamping member is in the open position. Once a nipple has been inserted into the aperture, the shaft is displaced so as to bring the clamping member into contact with the nipple, and thus grip the nipple. The device allows the strength of the grip exerted on the nipple to be varied. The device may be plated with a precious metal, and may be provided with any combination of adornments such as jewels, spikes, and studs, to increase its aesthetic appeal.

18 Claims, 6 Drawing Sheets

BODY JEWELRY

BACKGROUND OF THE INVENTION

This invention relates to body jewelry, and in particular, to jewelry for decorating a human breast.

It is customary in many cultures throughout the world to decorate the breasts, which typically involves attachment of jewelry to the nipple. This practice is becoming increasingly popular in the industrialized world, and has led to the development of a number of mechanical devices for attachment to the nipple.

For example, U.S. Pat. No. 4,625,526 to Milawski describes a nipple decoration device comprising a tubular semi-circular portion having a support arm for contacting a nipple slidably mounted at each end of the semi-circle. The support arms are biased towards each other by coil springs housed inside the semi-circular portion. The device is held in place on the nipple by the compressive force developed between the two support arms by the springs.

U.S. Pat. Nos. 5,125,244 and 5,239,841 to Zwart relate to jewelry and a method for decorating a human breast. The jewelry in these patents is a clamp in the form of a circular spring member that fits snugly around the nipple. The spring member may be provided with various decorative adornments and it may be plated with precious metals to increase its aesthetic appeal.

In both of the above prior art decorative devices, attachment of the device to the nipple relies on the spring pressure to hold it in place. Neither device provides a means by which the grip on the nipple may be adjusted, and increased if necessary, to maintain the device in place. This is problematic when an elaborate decoration is desired, because the jewelry will not remain attached if a sufficiently strong grip on the nipple is not provided. The prior art devices are thus limited in the range of decoration which may be attached to the nipple.

In addition, the size of the nipple may change substantially in response to variables such as temperature, exercise, and sexual stimulation. Because the range of sizes over which the prior art devices can maintain grip is determined by the range of travel of their spring-biased members, they are limited in their ability to accommodate such changes in size.

Piercing of the nipple may overcome the above-mentioned problems associated with the prior art devices. However, there is considerable discomfort associated with such procedure, which may discourage individuals from having their nipples pierced. A further drawback of piercing is that jewelry must be worn essentially continuously to maintain the pierced opening in the nipple. Thus, piercing is unsuitable for individuals wanting to decorate their breasts only occasionally.

It is known that a pleasurable sensation may be experienced from the application of pressure to a nipple. Whereas the prior art devices discussed above may provide such stimulation, such effects are likely to be short-lived as the nipple will become habituated to the pressure applied. It is thus necessary to increase the intensity of the stimulation, by increasing the pressure on the nipple, to maintain the desired effect. While other devices in which the amount of pressure to be applied is adjustable are commercially available, none are of an aesthetically pleasing design which lends them also to be used as jewelry.

SUMMARY OF THE INVENTION

It is an object of the invention to provide a jewelry device for decorating and stimulating the body, and in particular, for decorating and stimulating a human breast. A device according to the invention attaches to a desired part of the body, such as the nipple of the breast, and allows the pressure exerted thereon to be varied.

The invention provides a jewelry device which comprises a unitary body having an aperture defined therein; a bore through the unitary body opening into the aperture; a shaft disposed within said bore, the shaft having a first end outside the aperture and a second end inside the aperture; a clamping member surmounting the second end of said shaft and slidably disposed within the aperture for displacement between a substantially closed position adjacent an inside portion of the aperture and an open position spaced therefrom; and actuating means disposed on the first end of the shaft for longitudinal movement of the shaft to displace the clamping member towards or away from the closed position; the aperture being suitably sized to accommodate a part of the body when the clamping member is in the open position. In one embodiment, the aperture is suitably sized to accommodate the nipple of a human breast when the clamping member is in the open position.

In a preferred embodiment, the device further comprises a cylindrical portion formed on the unitary body and extending outwardly therefrom, for accommodating the bore substantially coaxially, an outer surface of the cylindrical portion being screw-threaded; and a screw-threaded bore disposed in the actuating means, for communicating with the threaded cylindrical portion of the unitary body, the screw-threaded bore of the actuating means having a bottom portion for engaging the first end of the shaft in a loose fit; wherein rotation of the actuating means in one direction displaces the clamping member towards the closed position, and rotation of the actuating means in a second direction allows the clamping member to be displaced toward the open position. The device optionally further comprises spring means for biasing the clamping member toward the open position.

In an embodiment of the invention the inside portion of the aperture is arcuate such that a radius thereof has its origin within the aperture, and the clamping member has a correspondingly arcuate face adapted to align with the arcuate portion of the aperture when in the closed position.

In a further embodiment of the invention, the clamping member and said inside portion of the aperture have opposing faces, at least one of the faces having gripping means formed thereon, the gripping means comprising an uneven surface, such as spaced parallel ridges, castellations, or protuberances.

To increase its aesthetic appeal, a device according to the invention may further be provided with adornments, which may comprise, for instance, any combination of jewels, studs, spikes, and trinkets. In addition, the invention may also be provided in various moulded or machined designs, and may include other forms of decoration such as engraving and embossing.

The device can be used to stimulate the nipple of a human breast, including sexual stimulation. Additionally, the device can be worn on clothing as a decoration or adornment, such as on lapels or hats.

The invention also provides a method for decorating a part of a human body or an item of clothing, comprising the steps of forming a unitary body having an aperture defined therein, the aperture being suitably sized to accommodate the part of the body or item of clothing to be decorated; providing a bore through the unitary body opening into the aperture for accommodating a shaft therein, the shaft having a first end outside the aperture and a second end inside the aperture; providing a clamping member surmounting the second end of said shaft within the aperture for displacement between a substantially closed position adjacent an inside portion of the aperture and an open position spaced therefrom; disposing actuating means on the first end of the shaft for effecting longitudinal movement of the shaft to displace the clamping member towards or away from the closed position; mounting the unitary body on the body part or an item of clothing to be worn such that said body part or item of clothing is within the aperture; and effecting longitudinal movement of the shaft to displace the clamping member towards the closed position, so as to clamp said body part or item of clothing in the unitary body.

BRIEF DESCRIPTION OF THE DRAWINGS

Embodiments of the invention will now be described, by way of example, with reference to the accompanying drawings, wherein.

DETAILED DESCRIPTION OF THE EMBODIMENTS

The following description of the invention will be given with respect to use of the device for decorating a human breast. However, the invention should not be construed as being limited thereto. The device of the invention may be used to decorate and/or to provide stimulation to various parts of the human body, as well as to decorate clothing, etc.

Figure 1:
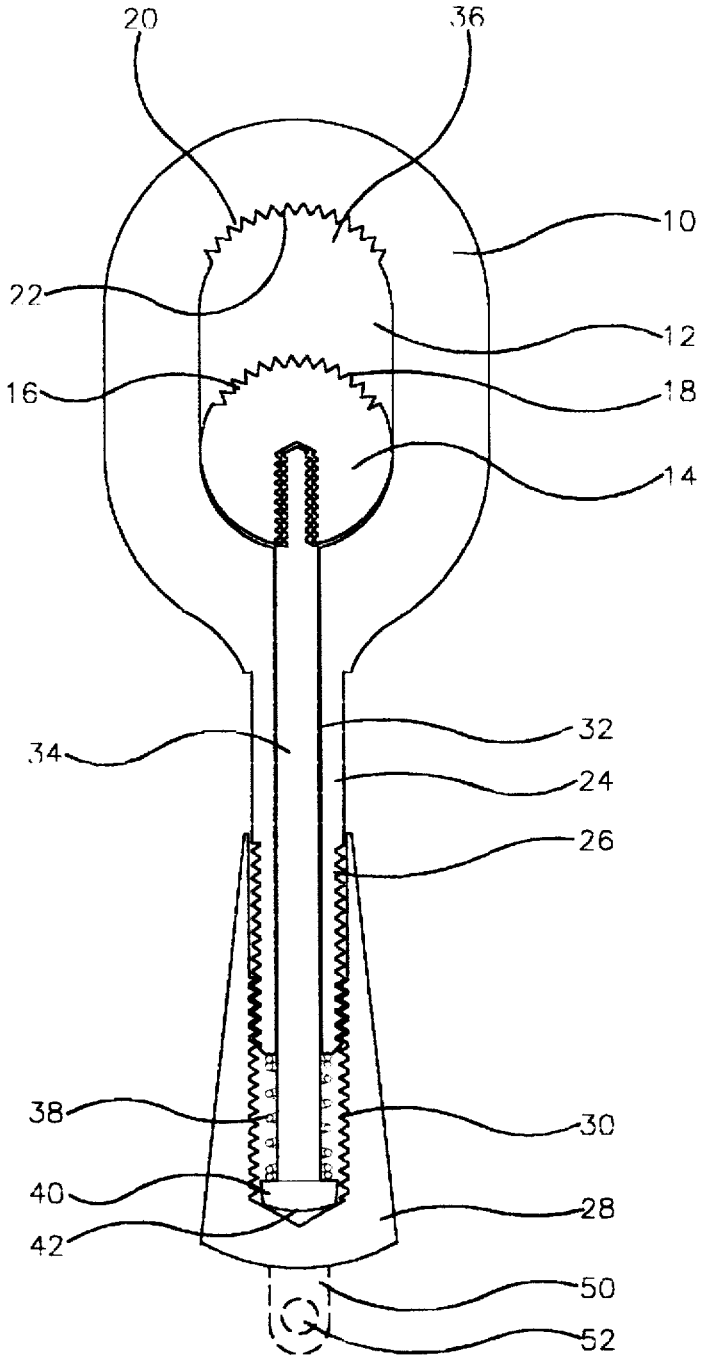
FIG. 1 is a longitudinal sectional view of a preferred embodiment of a device according to the invention.

With reference to FIG. 1, a device for decorating a human breast according to the invention comprises a unitary body 10 which defines an aperture 12. A clamping member 14 is disposed within the aperture 12 for sliding movement within the aperture 12. The inside walls of the body 10 that define the aperture 12 and the sides of the clamping member 14 are substantially perpendicular to a plane of the front surface thereof. Accordingly, during movement within the aperture, the clamping member 14 remains substantially coplanar with the body 10, owing to the close proximity of the perpendicular sides of the clamping member 14 and the body 10.

As shown in FIG. 1, the clamping member 14 has an arcuate face 16 which is provided with a series of substantially parallel ridges 18, which, in cross-section, are in the form of an inverted "V" so as to give a milled effect. An end portion 20 of the unitary body 10 is correspondingly arcuate, and is also provided with a series of ridges 22. The ridges 18, 22 provide a gripping surface for improving the grip of the device on a nipple.

It should be noted that the face 16 of the clamping member and the end 20 of the body are not limited to the shape shown in FIG. 1. For instance, they may be flat, arcuate, or any other shape. Also, the face 16 of the clamping member and/or the arcuate end portion 20 of the body may each be provided without a gripping surface (i.e. they may be smooth), or with any pattern or style of gripping surface, such as the ridges shown in FIG. 1, or any other style of ridges, protuberances, or castellations.

One end of the unitary body 10 is elongated so as to form a cylindrical portion 24. An outer surface of the cylindrical portion 24 has a screw thread 26. A handle 28 has a correspondingly screw-threaded bore 30 for receiving the threaded cylindrical portion 26. The cylindrical portion 24 is further provided with a substantially coaxial bore 32 which extends through the cylindrical portion 24 and the body 10 into the aperture 12. The bore 32 accommodates a shaft 34 in a sliding fit. One end of the shaft 34 engages the clamping member 14 in a tight fit, while the opposite end of the shaft 34 extends beyond the cylindrical portion 24 of the body 10 and is surmounted by the handle 28 in a loose fit. Rotation of the handle 28 about its longitudinal axis in one direction advances the shaft 34 and hence the clamping member 14 towards an end 36 of the aperture 12, whereas rotation of the handle 28 in an opposite direction allows the clamping member 14 to be displaced away from the end 36 of the aperture 12. As the handle 28 is rotated in either direction it advances or retracts over the cylindrical portion 24 telescopically. The length in which the shaft 34 is provided may be adjusted to allow the clamping member 14 to be fully advanced towards the end 36 of the aperture 12 if desired.

In the embodiment shown in FIG. 1, a coil spring 38 is optionally coaxially disposed over the shaft 34. The shaft 34 is provided with a flange 40 for retaining the spring 38, such that the shaft 34 and hence the clamping member 14 is biased away from the end 36 of the aperture 12. Accordingly, as the handle 28 is screwed onto the cylindrical portion 26 the spring 38 is compressed, and as the handle is unscrewed from the cylindrical portion 26, the clamping member 14 is automatically withdrawn from the end 36 of the aperture 12 by the force of the spring 38.

As shown in dashed lines, the embodiment of FIG. 1 may optionally be provided with a tab 50 having an opening 52 therethrough. The opening 52 may be suitably sized to receive a clasp, such as a jewelry clasp typically used for attaching opposite ends of a chain, or to receive any other item of jewelry. Accordingly, the opening 52 may be a circular bore, as shown in FIG. 1, or it may be of any other shape such as an elongated slot. The tab 50 and/or opening 52 may be made of a metal, such as an electrically conductive metal, and may also be used to connect, via wires or suitable means, a source of electric current to the device, for the purpose of providing a modulated electrical charge for additional stimulation to the user. The tab 50 may be constructed so as to rotate independently of the handle 30 to prevent any jewelry or wires attached thereto from becoming tangled when the handle 30 is rotated. The opening 52 may be disposed anywhere on the handle 30, body 10, or clamping member 14, either alone or with the tab 50. Further, a plurality of such openings may be provided, for cooperating with other types of jewelry such as those associated with body piercing.

It is contemplated that the invention could be available to a user in the form of a kit of parts, from which the user could assemble the device by following simple instructions. The kit could contain a variety of unitary bodies 10, clamping members 14, and handles 28, each of such components having different finishes, shapes, openings, and ornamentation (described in detail below), etc. Interchangeability of the components would allow a user to create numerous different looks from the same jewelry kit.

Thus, whereas the clamping member 14 may be permanently attached to the shaft 34 by any suitable means, such as by press-fitting, with adhesives, soldering, etc., it is preferable that the clamping member 14 is removably attached to the shaft 34 using screw threads, as shown in FIG. 1. In this case an end face 42 of the flange 40 may be provided with a keying recess for accepting a tool such as a screwdriver or hexagonal key, to facilitate easy removal and replacement of the clamping member 14.

Figure 2:
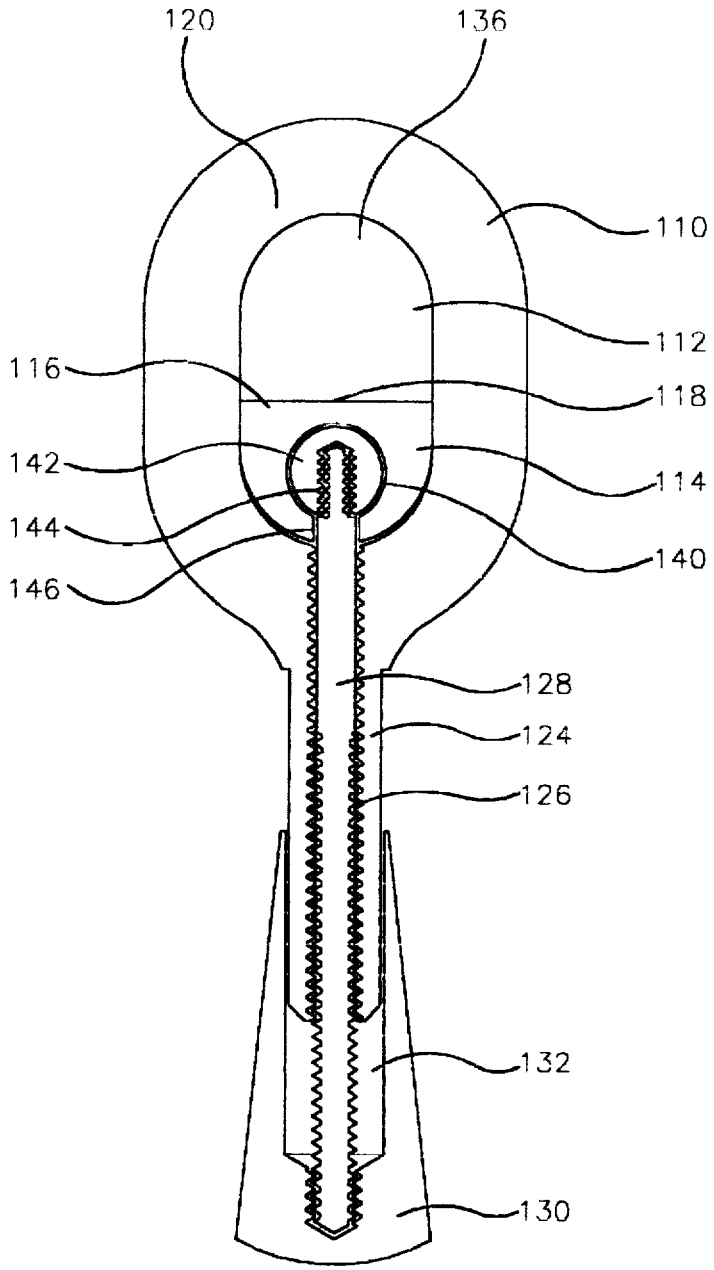
FIG. 2 is a longitudinal sectional view of an alternative embodiment of a device according to the invention.

An alternative embodiment of the invention is shown in FIG. 2. This embodiment is similar to that shown in FIG. 1 in that it comprises a unitary body 110 which defines an aperture 112, having a clamping member 114 slidably disposed therein. The clamping member 114 has a substantially straight, flat face 116, and an end portion 120 of the unitary body 110 is arcuate. The body 110 and clamping member 114 have sides that are substantially perpendicular to a plane of the front surface thereof. Accordingly, during movement within the aperture, the clamping member 114 remains substantially coplanar with the body 110, owing to the close proximity of the perpendicular sides of the clamping member 114 and the body 110.

According to the embodiment, one end of the unitary body 110 is elongated so as to form a cylindrical portion 124. A bore 126 is substantially coaxial with the cylindrical portion 124 and extends through the cylindrical portion 124 and the body 110 into the aperture 112. At least a portion of the bore 126 is screw-threaded. The screw-threaded bore 126 accommodates a screw 128 disposed therein. One end of the screw 128 is surmounted by the clamping member 114, while the opposite end of the screw 128 extends beyond the cylindrical portion 124 of the body 110 and is fixed to a handle 130 for turning the screw 128. The handle 130 has a longitudinal bore 132 for accommodating the cylindrical portion 124 of the body 110 in a loose fit. Rotation of the handle 130 and thus the screw 128 about its longitudinal axis in one direction advances the clamping member 114 towards an end 136 of the aperture 112, whereas rotation of the screw 128 in an opposite direction retracts the clamping member 114 away from the end 136 of the aperture 112. As the handle 130 is rotated in either direction it advances or retracts with the screw 128, and hence travels over the cylindrical portion 124 telescopically. The length of the screw 128 and the bore 126 may be sufficient to allow the clamping member 114 to be advanced towards the end 136 of the aperture 112 as far as desired within the aperture 112.

It will be appreciated that the clamping member 114 engages the screw 128 in a manner that permits the screw 128 to rotate freely therein, so that torque is not applied to the clamping member 114 when the screw 128 is rotated about its longitudinal axis. This contributes to the clamping member 114 remaining substantially coplanar with the plane of the body 110. For example, as shown in FIG. 2, the clamping member 114 may be provided with a first bore 140 for accepting a ball bearing 142 in a loose fit. The clamping member 114 may be further provided with a second bore 146 which is substantially coaxial with the screw-threaded bore 126 when the clamping member 114 is positioned within the aperture 112. The second bore 146 opens into the first bore 140 and accommodates the screw 128 in a loose fit. The ball bearing 142 has a bore 144 for engaging an end of the screw 128 in a tight fit. Thus, the ball bearing 142 and screw 128 assembly are captured by the clamping member 114, and can rotate about the longitudinal axis of the screw 128 independently of the clamping member 114.

As shown in FIG. 2, the ball bearing 142 may accommodate the screw 128 by means of screw-threads, or any other suitable means of attachment may be employed. It will also be appreciated that the handle 130 is fixed to the screw 128 in a manner that prevents relative movement between the two, such as screw-threads as shown in FIG. 2, or by soldering, adhesive, etc.

The device of the invention may be constructed from any suitable material including plastics and metals, either alone or in combination. Preferably, the device is made of a metal such as brass. The device or portions of it may also be plated with a precious metal such as silver or gold, or a non-precious metal such as pewter or chromium, to increase its aesthetic appeal. Further, other finishes such as painting, anodizing, or rubber coating may be used.

Figure 3A:
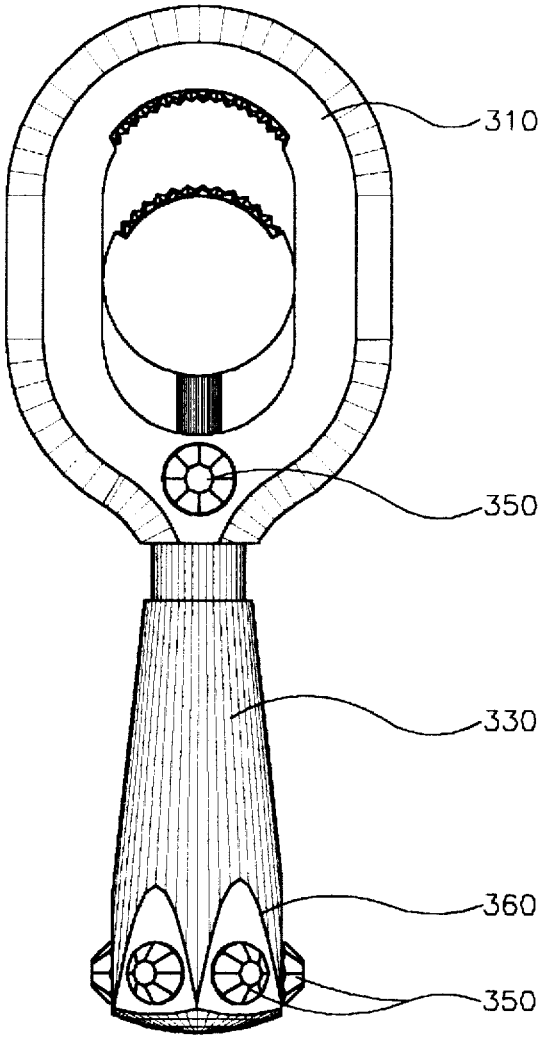
FIG. 3*a* is a front view of a further embodiment of a device according to the invention.
Figure 3B:
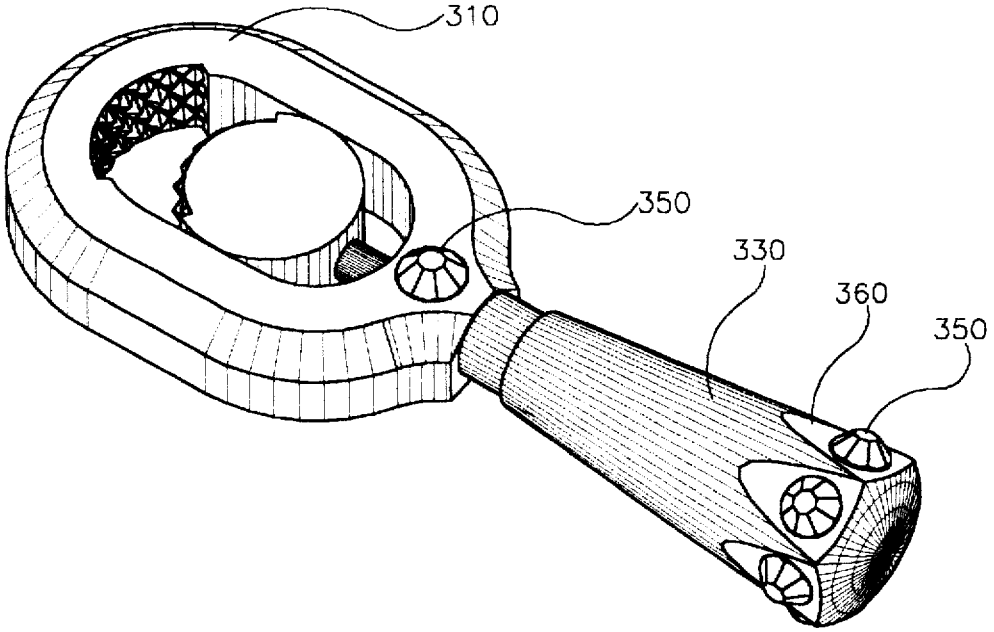
FIG. 3*b* is a perspective view of the embodiment shown in FIG. 3*a;*

As shown in FIGS. 3*a* and 3*b*, the device may further be provided with adornments such as jewels 350. The embodiment illustrated has seven jewels, one on the body 310 and six (four are shown) on the handle 330. In addition, a series of bevels 360 has been formed on an end of the handle 330 for placement of the jewels 350 thereon. The jewels may be made of plastics, glass, or stone, including precious stones, and may be attached to the device using a suitable adhesive or by any suitable mechanical means. Further, any size, combination, and placement of jewels may be used, so long as the operation of the device is not impaired by such use.

Figure 4:
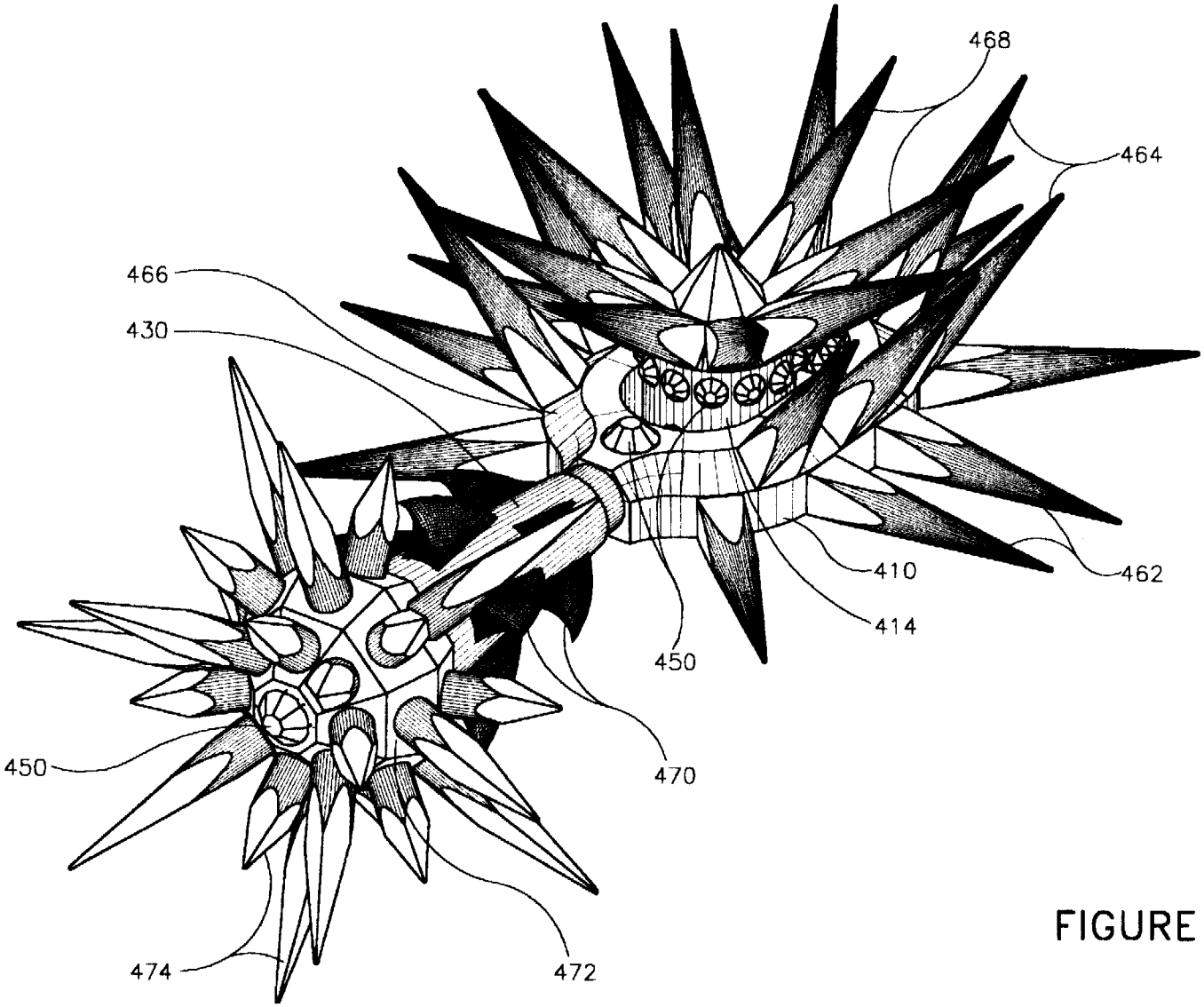
FIG. 4 is a perspective view of a further embodiment of the invention.

It will be appreciated from the above that a device according to the invention may be elaborately decorated. FIG. 4 exemplifies an elaborate device having a body 410 and jewels 450 disposed on an end of the handle 430, the body 410, and the clamping member 414. The device is additionally decorated with spikes. The body 410 of the device is provided about its perimeter with a series of nine spikes generally referred to by reference numeral 462. A second series of eight spikes, generally referred to by reference numeral 464, is disposed on a bevelled edge 466 of the body 410. A third series of eight spikes, generally referred to by reference numeral 468, is mounted on the clamping member 414. The handle 430 has formed thereon a series of cusp-shaped spikes 470. Finally, a multi-facetted, generally spherical portion 472 is formed at an end of the handle 430. Each facet of the spherical portion 472 is provided with a spike, generally referred to by reference numeral 474.

The spikes 462, 464, 468, 474 may be forged, moulded, cast, or machined with the body 510 as a unit. Alternatively, the spikes may be fabricated from the same material as the body of the device, or they may be made from any other suitable material. For attaching the spikes to the device, each spike may be provided with a base portion which is cylindrical about a longitudinal axis of the spike. A bore of a diameter for receiving the cylindrical portion of a spike in a snug fit may be provided in, for example, the body 410 of the device. A spike may thus be positioned as desired and fixed in place by soldering, applying an adhesive, or any other suitable means. Additionally, the cylindrical base portion of a spike may be screw-threaded, and a bore for receiving the spike may be correspondingly screw-threaded, such that the spike may be screwed in place, and, if desired, the number, arrangement, size, or type of spikes may be varied.

Figure 5:
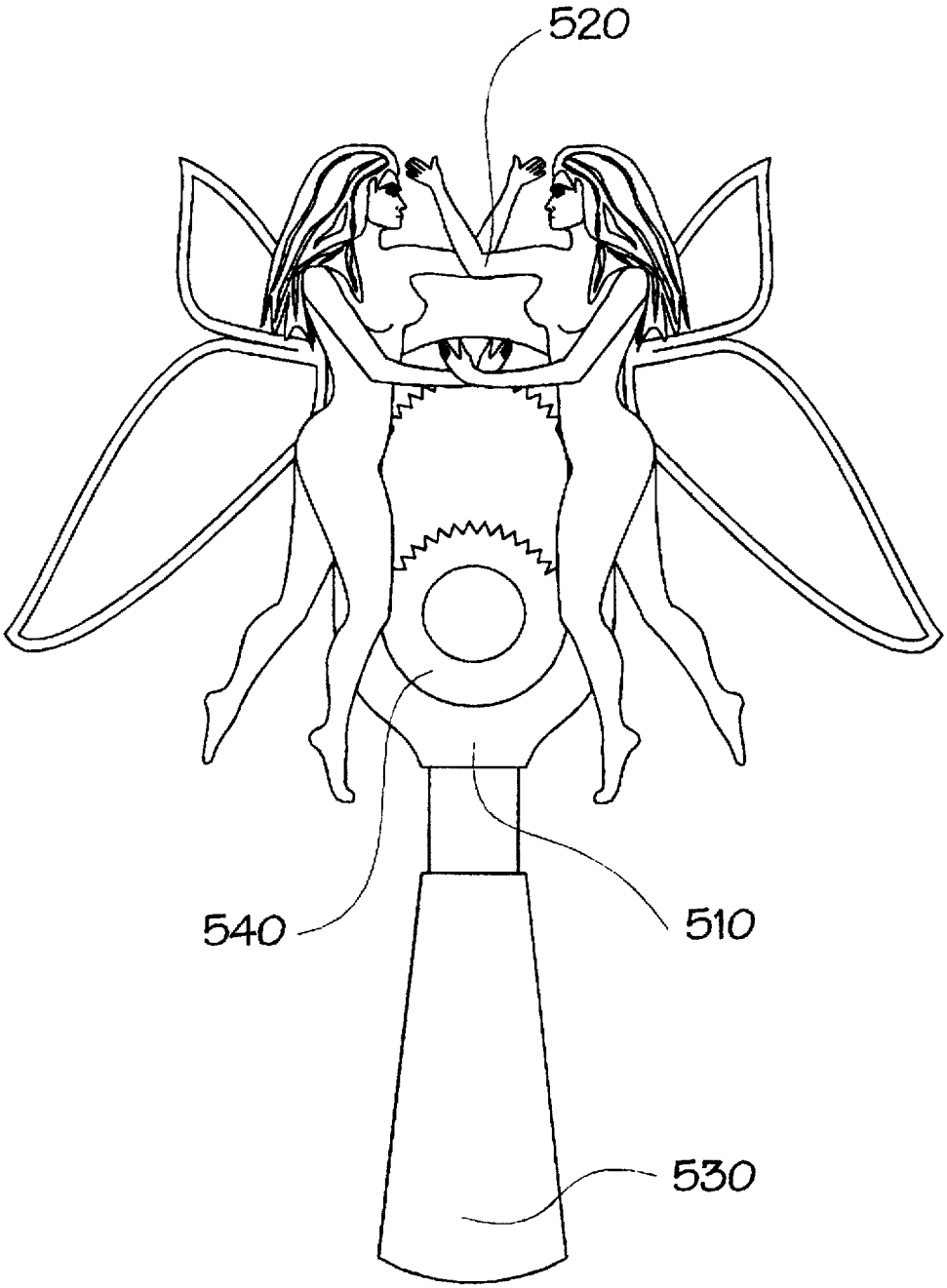
FIG. 5 is a front view of yet another embodiment of the invention.

A further embodiment of the invention is illustrated in FIG. 5, and shows an example of another form of adornment 520 which may be provided on the body 510 of the device. The adornment may be unitary with the body 510, and produced by casting or machining, or may be fixed to the body by soldering or with an adhesive, etc. Such adornment may also be provided on the handle 530 and/or the clamping member 540 of the device. The adornment 520 may also be removably attached to the body, handle, or clamping member using any suitable means such as clips or screws. The latter are preferable if the device is obtained in kit form, as mentioned above, in which case other adornments could be available and could be interchanged as desired.

The embodiments of the invention in which an exclusive property or privilege is claimed are defined as follows:

1. A jewelry device which comprises:

a unitary body having an aperture defined therein;

a bore through the unitary body opening into the aperture;

a shaft disposed within said bore, the shaft having a first end outside the aperture and a second end inside the aperture;

a clamping member surmounting the second end of said shaft and slidably disposed within the aperture for displacement between a substantially closed position adjacent an inside portion of the aperture and an open position spaced therefrom; and actuating means engaging the first end of the shaft for effecting longitudinal movement of the shaft to displace the clamping member towards or away from the closed position.

2. A device according to claim 1, further comprising:

a cylindrical portion formed on the unitary body and extending outwardly therefrom, for accommodating said bore substantially coaxially, an outer surface of the cylindrical portion being screw-threaded; and a screw-threaded bore disposed in the actuating means, for communicating with the threaded cylindrical portion of the unitary body, the screw-threaded bore of the actuating means having a bottom portion for engaging the first end of the shaft in a loose fit;

wherein rotation of the actuating means in one direction displaces the clamping member toward the closed position, and rotation of the actuating means in a second direction allows the clamping member to be displaced toward the open position.

3. A device according to claim 2, further comprising spring means for biasing the clamping member toward said open position.

4. A device according to claim 3, wherein said spring means is a coil spring.

5. A device according to claim 1, wherein at least a portion of the bore is screw-threaded, the shaft is correspondingly screw-threaded, and the actuating means is fixed to the first end of the shaft, such that rotation of the actuating means in one direction displaces the clamping member toward the closed position, and rotation of the actuating means in a second direction displaces the clamping member toward the open position.

6. A device according to claim 1, wherein said aperture is suitably sized to accommodate the nipple of a human breast when the clamping member is in an open position.

7. A device according to claim 1, wherein said inside portion of the aperture is arcuate such that a radius thereof has its origin within the aperture, and wherein the clamping member has a correspondingly arcuate face adapted to align with the arcuate portion of the aperture when in the closed position.

8. A device according to claim 1, wherein the clamping member and said inside portion of the aperture have opposing faces, at least one of said faces having gripping means formed thereon.

9. A device according to claim 8, wherein said gripping means comprises ridges, castellations, or protuberances.

10. A device according to claim 1, wherein a plane of the clamping member remains substantially coplanar with a plane of the unitary body while being displaced within the aperture.

11. A device according to claim 1, further comprising any combination of adornments disposed thereon.

12. A device according to claim 11, wherein said adornments are chosen from the group comprising jewels, studs, spikes, animal motifs, and plant motifs.

13. A device according to claim 12, wherein the device is provided with at least one additional component selected from unitary body, clamping member, handle, and adornment, each additional component being different in size, shape, finish, or adornment from its corresponding component, and wherein a user may interchange components of the device with corresponding additional components as desired.

14. A device according to claim 1, further comprising at least one opening disposed through the actuating means, the unitary body or the clamping member.

15. A device according to claim 14, wherein said opening is formed in a tab extending from the actuating means, the unitary body or the clamping member.

16. A device according to claim 15, wherein said tab is capable of rotation about an axis thereof independent of any rotation of the actuating means, the unitary body or the clamping member from which it extends.

17. A method for decorating a part of a human body or an item of clothing, comprising the steps of:

forming a unitary body having an aperture defined therein, the aperture being suitably sized to accommodate the part of the body or item of clothing to be decorated;

providing a bore through the unitary body opening into the aperture for accommodating a shaft therein, the shaft having a first end outside the aperture and a second end inside the aperture;

providing a clamping member surmounting the second end of said shaft within the aperture for displacement between a substantially closed position adjacent an inside portion of the aperture and an open position spaced therefrom;

disposing actuating means on the first end of the shaft for effecting longitudinal movement of the shaft to displace the clamping member towards or away from the closed position;

mounting the unitary body on the body part or item of clothing to be worn such that said body part or an item of clothing is within the aperture; and effecting longitudinal movement of the shaft to displace the clamping member towards the closed position, so as to clamp said body part or item of clothing in the unitary body.

18. A method according to claim 17, further comprising the step of providing at least one of the unitary body, clamping member, and actuating means with adornments selected from the group comprising studs, spikes, jewels, animal motifs, and plant motifs.

* * * * *